United States Patent [19]

Markwardt

[11] Patent Number: 4,836,800

[45] Date of Patent: Jun. 6, 1989

[54] ELECTRICAL CONNECTOR (WITH TELESCOPING FOR SEALING)

[75] Inventor: Terrance L. Markwardt, Cedar Park, Tex.

[73] Assignee: Minnesota Mining and Manufacturing Company, St. Paul, Minn.

[21] Appl. No.: 152,452

[22] Filed: Feb. 5, 1988

[30] Foreign Application Priority Data

Feb. 20, 1987 [JP] Japan ..... 62-37695

[51] Int. Cl.[4] ..... H01R 4/24

[52] U.S. Cl. ..... 439/291; 439/395

[58] Field of Search ..... 439/290, 291, 389, 391, 439/395, 396, 397, 399, 400, 401, 406, 407, 417, 418

[56] References Cited

U.S. PATENT DOCUMENTS 4,560,226 12/1985 Dennis ..... 439/395

FOREIGN PATENT DOCUMENTS 1490376 5/1973 Fed. Rep. of Germany ..... 439/291

2497413 7/1982 France ..... 439/291

*Primary Examiner*—Joseph H. McGlynn

*Attorney, Agent, or Firm*—Donald M. Sell; Walter N. Kirn; John C. Barnes

[57] ABSTRACT

A plugable connector for splicing telephone cables comprising a pair of connector bodies each having a plurality of contact elements, one body with a male terminal and the other with a female terminal and said female terminal being in a recess and each male terminal being surrounded by an insulating wall to fit within said recess when said terminals are joined.

2 Claims, 10 Drawing Sheets

ELECTRICAL CONNECTOR (WITH TELESCOPING FOR SEALING)

BACKGROUND OF THE INVENTION

1. Field of the Invention

This invention relates to a connector for splicing telephone cables and, in particular, to a connector suitable for splicing telephone cables comprising copper wires whose diameter are in the range from 0.3 mm to 0.9 mm inclusive.

2. Description of the Prior Art

In prior art connectors for telephone cables, protection for the terminals of contact elements is not sufficient and also alignment between the female and male terminals was frequently imperfect. By eliminating such drawbacks, this invention intends to provide a connector for telephone cables which is simple in structure and in which each terminal may be given full protection and at the same time guided with reliability.

SUMMARY OF THE INVENTION

In the present invention, the male terminal is surrounded by an insulating wall, the female terminal is positioned in a recess adjacent to said male terminal, and said insulating wall which surrounds the male terminal is of a configuration to fit within the recess around the female terminal. Further, the insulating wall and recess are arranged to provide each terminal with sufficient protection and, at the same time, to help each terminal connect securely at a proper location by guiding the wall into the recess.

DESCRIPTION OF THE PREFERRED EMBODIMENT

In the following, a preferred embodiment of the invention will be described with the reference to the accompanying drawings.

Figure 3:
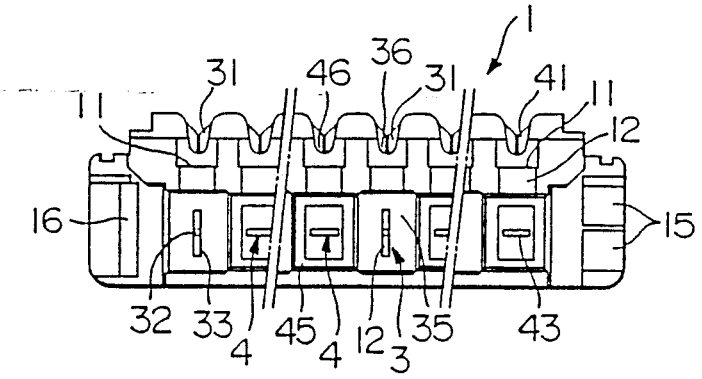
FIG. 3 is a front view of the body shown in FIG. 2.
Figure 4:
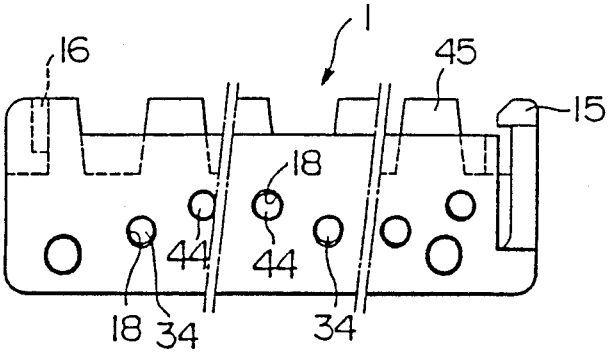
FIG. 4 is a bottom view of the body shown in FIG. 2.
Figure 5:
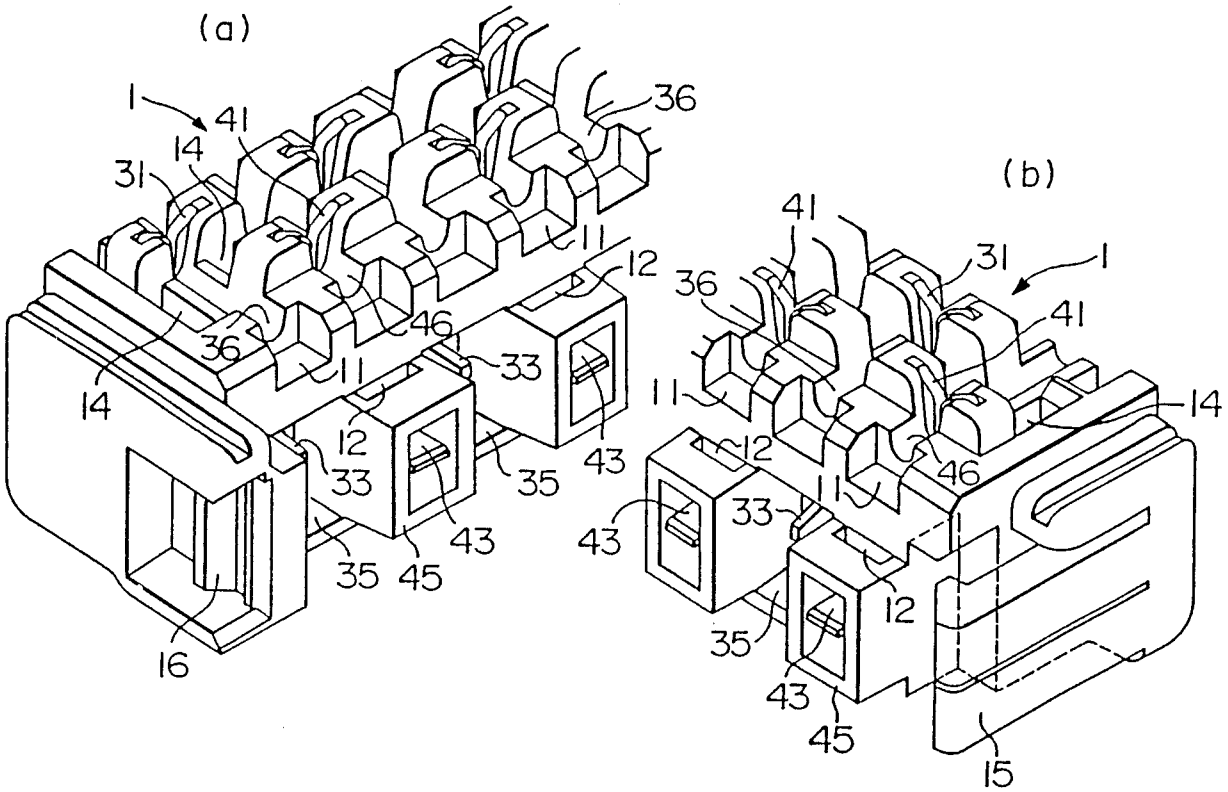
FIG. 5 is an enlarged perspective view showing essential portions of the body shown in FIG. 2, in which (*a*) shows one end portion and (*b*) shows the other end portion of the same body and also an end portion of the other body.
Figure 6:
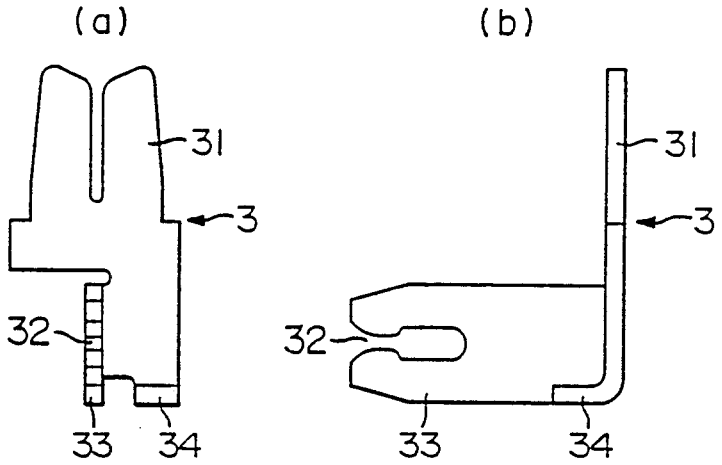
FIG. 6 is an enlarged view of a female contact element mounted to the body shown in FIG. 2, in which (*a*) is a front view and (*b*) is a side view.
Figure 7:
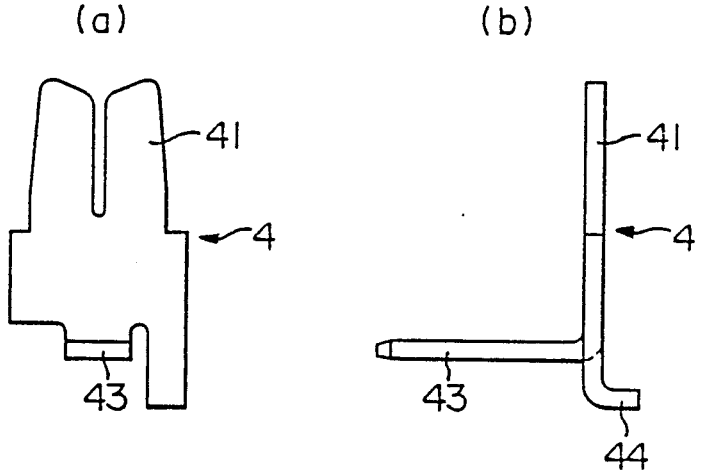
FIG. 7 is an enlarged view of a male contact element mounted to the body shown in FIG. 1, in which (*a*) is a front view and (*b*) is a side view.
Figure 8:
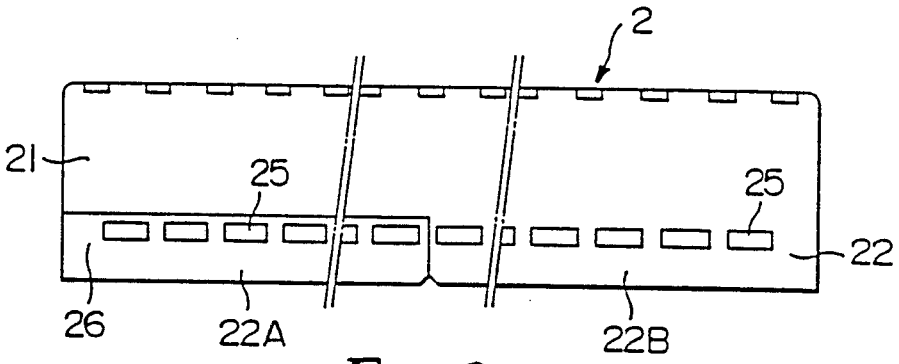
FIG. 8 is a plan view of a cover mounted to the body shown in FIG. 2.
Figure 9:
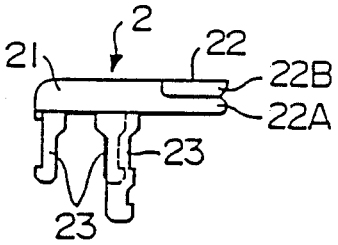
FIG. 9 is a side view of the cover shown in FIG. 8.
Figure 10:
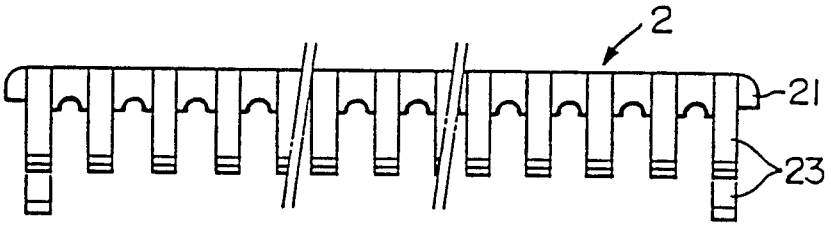
FIG. 10 is a rear view of the cover shown in FIG. 8.
Figure 11:
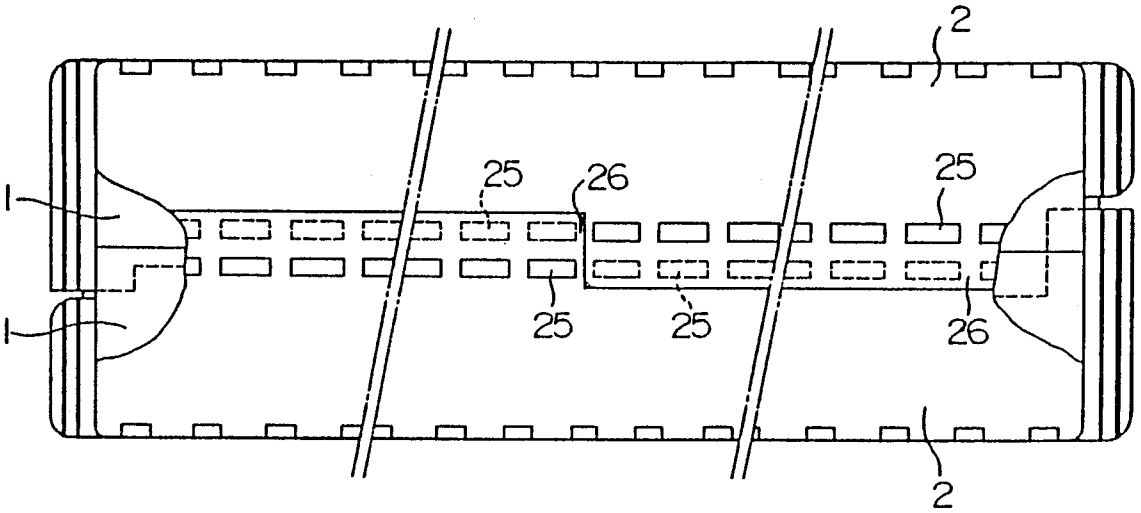
FIG. 11 is a plan view of a connector having a pair of bodies connected respectively to a pair of covers.
Figure 12:
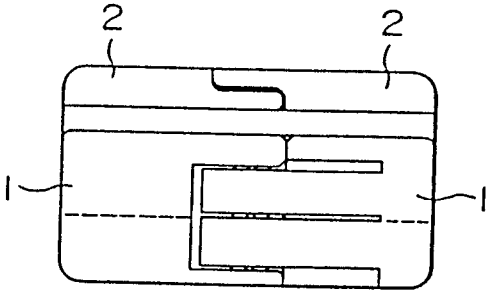
FIG. 12 is a side view of the connector shown in FIG. 11.
Figure 13:
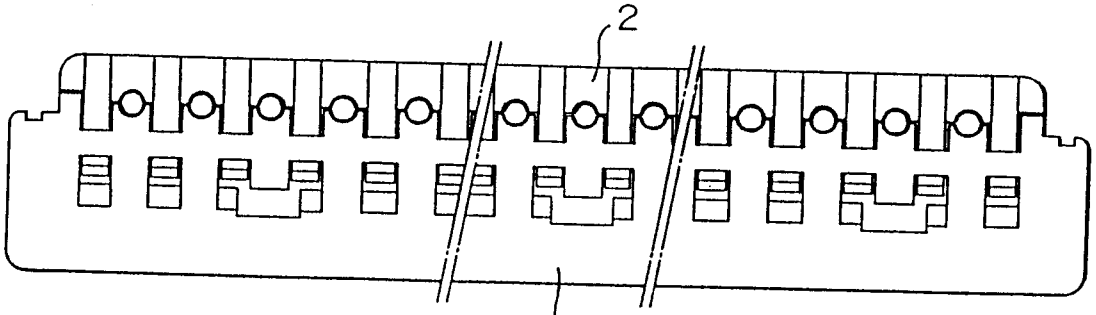
FIG. 13 is a rear view of the connector shown in FIG. 11.

The invention connector comprises two bodies 1 as seen in FIGS. 1 to 5 and two covers 2 mounted respectively to the two bodies as seen in FIGS. 8 to 10. Each of the bodies 1 is provided with a female contact element 3 as shown in FIG. 3 and a male contact element 4 as shown in FIG. 7.

The female contact element 3 is configured generally L-shaped and comprises a U-shaped wire receiving portion 31 at one end thereof and comprises at the other end thereof a terminal 33 having an opening 32. And, the female contact element 3 has a portion thereof bent to define a testing tab 34.

The male contact element 4 is also configured in a generally L-shape and comprises a U-shaped wire receiving portion 41 at one end thereof and comprises at the other end thereof a terminal 43 of a thickness fitting dimensionally to the opening 32 of the female contact element 3, and said male contact element 4 has a portion thereof bent to define a testing tab 44.

The female contact elements 3 and male contact elements 4, structured as above described, are alternately arranged on the body 1 so as to be capable of respectively engaging with the similarly structured mating contact elements of the other body 1.

At the frontal face of the body 1, the terminal 43 of the male contact element 4 is surrounded by a square wall 45 of an insulated material and the terminal 33 of the female contact element 3 is positioned within a recess 35 formed between the adjacent walls 45. Each wall 45 approximately corresponds in its outer configuration to that of each recess 35 so that the wall 45 of one body may be guided into the recess 35 of the other body so as to be positively fitted therein.

At the upper portion of the body 1, the wire receiving portions 31, 41 of the female and male contact elements 3, 4 project in a zigzagged manner toward each other. And, adjacent to these wire receiving portions 31, 41 are formed wire paths 36, 46 in which wires 5 (see FIGS. 18, 19) can be placed. Further, said paths 36, 46 are formed on the respective front lateral end portions thereof with wire cutoff pads 11 against which wire cutoff blades 6, to be later described, may strike.

Within the interior of the body 1, a passage 13 (FIG. 19) is formed which extends from the space around the male terminal 43 to a grease distributing hole 12 in the vicinity of the wire receiving portion 41. Through this passage 13, as described later, grease may be supplied to the wire receiving portions 41, 31, etc.

Further, the body 1 is formed with openings 14 which can receive therein legs 23 described later of a cover 2. Furthermore, on one end portion thereof, the body 1 is formed with locking claws 15 and, on the other end portion, formed with projections 16 which can complimentarily engage with the claws 15. Besides, the body 1, on its bottom portion, is formed with openings 18 through which the respective tabs 34, 44 of the female and male contact elements 3, 4 can be exposed so as to allow inspection of the state of the wires 5 which have been mounted.

Now, an explanation will be made of the connector cover 2, referring to FIG. 1 and FIGS. 8 to 10.

Figure 14:
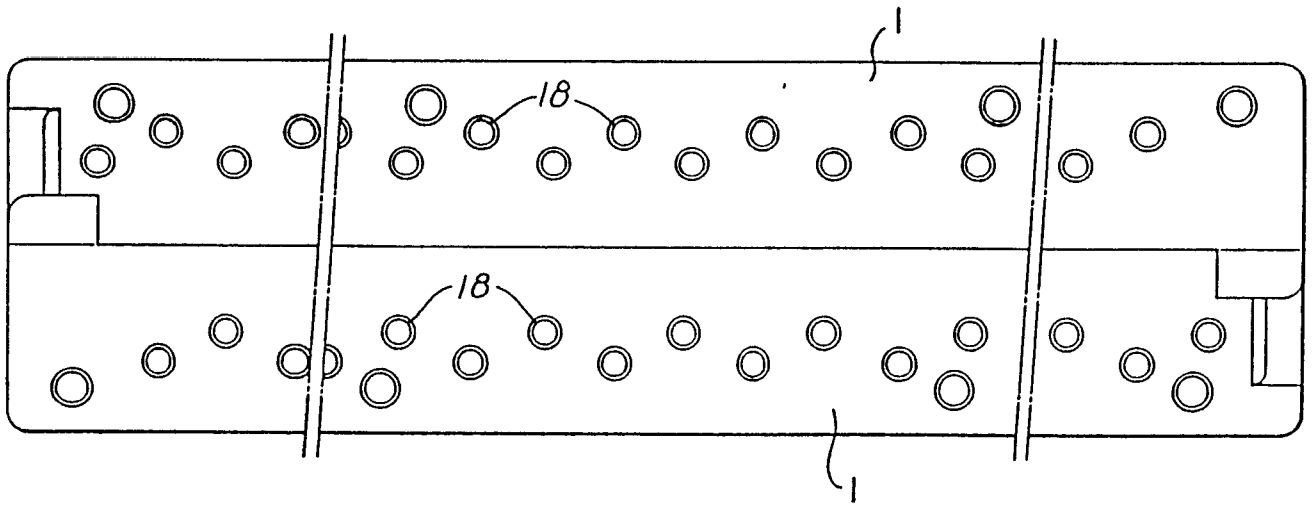
FIG. 14 is a bottom view of the connector shown in FIG. 11.

The cover 2 comprises a planar cover body 21 capable of covering the main portion of the body 1 and a rather thin-walled edge portion 22 extending along said cover body 21. The cover body 21 is provided on the lower portion thereof with a number of the legs 23 insertable into the openings 14 defined in the connector body 1. Each leg 23 has a projection 24 made thereon so as to be engagedly held by the projection 16 (FIGS. 14 to 16) formed in the opening 14 of the connector body 1.

On the edge portion 22 of the cover 2, there are wire cutoff holes 25 formed along the edge of the cover respectively at the places which will come above the wire cutoff pads 11 when the cover 2 is assembled to the connector body 1. And, on the outside of the wire cutoff holes 25, there are left, along the edge of the cover 2, hole covering portions 26 for respectively covering similar holes on the counterpart cover constituting a pair with the cover 2.

Further, the edge portion 22 is divided nearly at the center thereof into two portions 22A, 22B of an almost same length, one portion 22A, as seen from FIG. 8, being made lower than the other portion 22B by the distance corresponding to the thickness of the edge portion 22. Thus, when two similarly structured covers 2, 2 are assembled together as shown in FIG. 10, the lower portion 22A of one cover 2 is capable of being inserted to the under side of the higher portion 22B of the other cover 2 so that the tip surfaces of two covers 2, 2 may become substantially coplanar and moreover the respective hole covering portions 26 may positively block the other cover holes 25 from the upper or under side thereof.

FIGS. 11, 12, 13, and 14 show the state of the connector when its pair of bodies 1, 1 and pair of covers 2, 2 have all been connected to each other. In these drawings, however, the illustrations of telephone cable wires are omitted.

Figure 15:
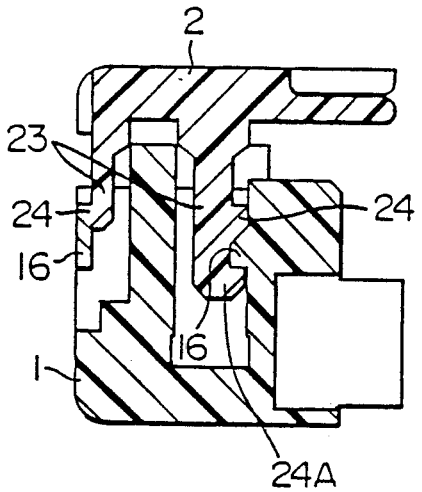
FIGS. 15, 16, and 17 are enlarged views jointly showing a sequence for connecting as shown in FIG. 11 the bodies and covers to each other, FIG. 15 being a sectional view of one connector half, FIG. 16 being a sectional view of the other connector half, and FIG. 17 being a sectional view showing the connector constructed by mutually connecting the connector halves respectively shown in FIG. 15 and FIG. 16.

To connect as noted above a pair of similarly structured bodies 1, 1 and a pair of similarly structured covers 2, 2 to each other, first of all, as shown in FIG. 15, onto one body 1 is placed one cover 2, which then is subjected to a strong pressure so that the projection 24 of the leg 23 on the cover 2 is engagedly locked by the projection 16 of the body 1 thereby achieving integral connection thereof. In the preferred embodiment, each leg 23 is provided, in addition to the protection 24 for final locking of the cover 2, with rather smaller projections 24A for temporary locking of the cover 2.

Figure 16:
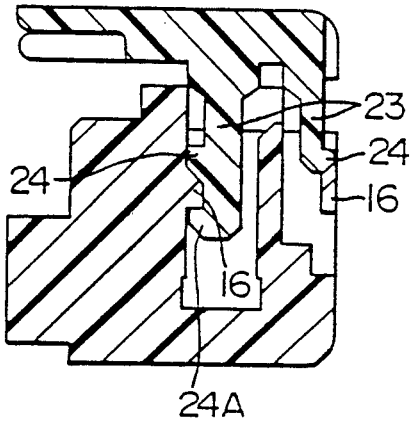

Similarly, to the other body 1 is connected the other cover 2 by way of a step shown in FIG. 16.

Figure 17:
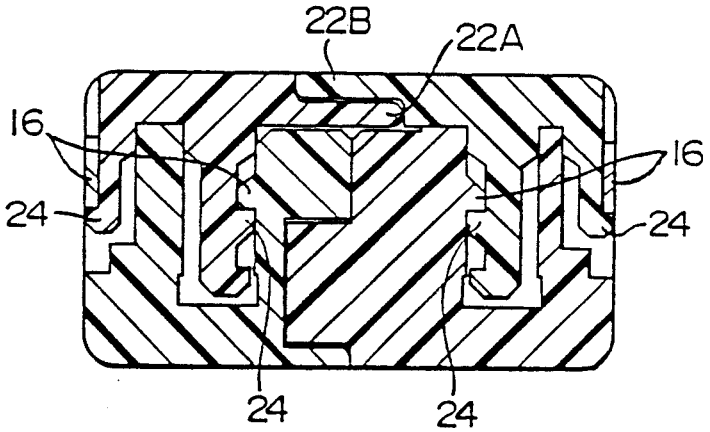

Thus, by then mutually pressing as shown in FIG. 17 two connector halves in each of which the body 1 has been connected to the cover 2, the wall 45 of one body 1 is caused to fit into the recess of the counterpart body 1 and the lower edge portion 22A of one cover 2 is inserted into the under side of the higher edge portion 22B of the other cover 2 so that the holes 25 of the covers 2 are covered as previously described. Naturally, at this time, into the opening 32 of each female terminal 33 is inserted each male terminal 43 corresponding to the latter so that each of the contact elements 3, 4 can be subjected to mutual electric connection. Besides, the claws 15 of the body 1 are caused to be engaged with and locked by the projections 16 of the counterpart body 1 thereby assuring their positive connection.

Next, a method of splicing telephone cable wires using the connector of this invention will be explained referring to FIGS. 1, 18, and 19.

Figure 18:
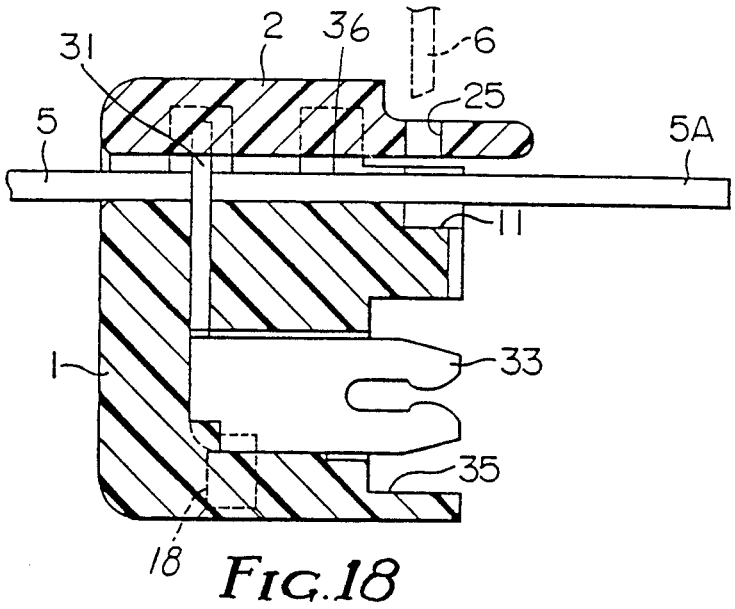
FIGS. 18 and 19 are enlarged views jointly showing a sequence for splicing telephone cable wires by the invention connector, FIG. 18 being a sectional view of one connector half, and FIG. 19 being a sectional view of the other connector half.
Figure 19:
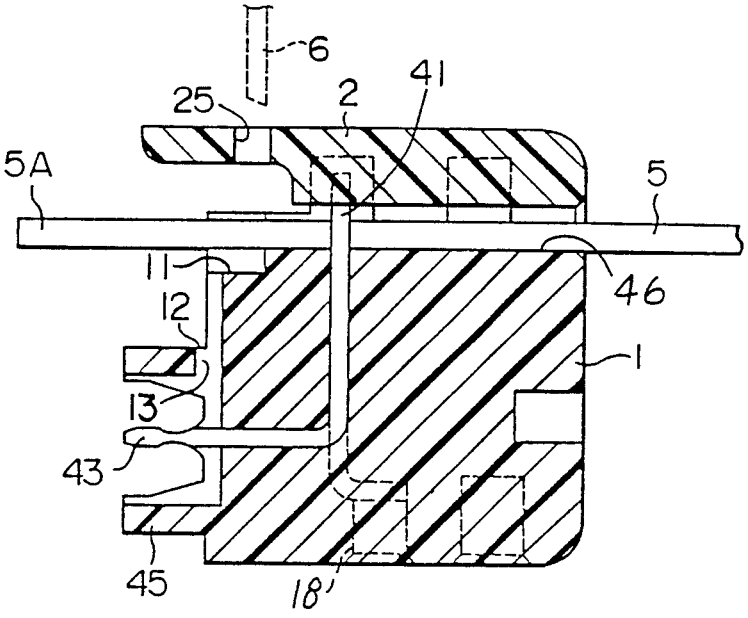

Firstly, as shown in FIGS. 18 and 19, the wires 5 are placed respectively in the wire receiving portions 31, 41 of the bodies 1 with surplus portions 5A of the wires 5 being retained respectively on the wire cutoff pads 11.

Then, the covers 2 are respectively pressed onto the bodies 1 as previously described. As a result, the wires 5 are electrically connected to the respective contact elements 3, 4 in the manner well known in the art.

In such condition, through the wire cutoff holes 25 of the covers 2 the wire cutoff blades 6 are pushed down to the pads 11 using a desired tool (not shown), thereby the surplus portions 5A of all the wires 5 are cut off.

Figure 1:
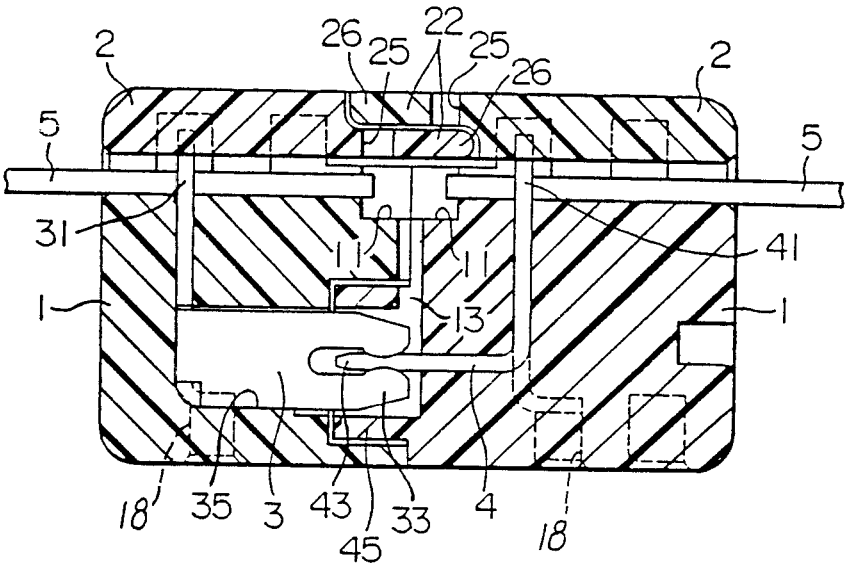
FIG. 1 is a sectional view of a connector according to the invention.
Figure 2:
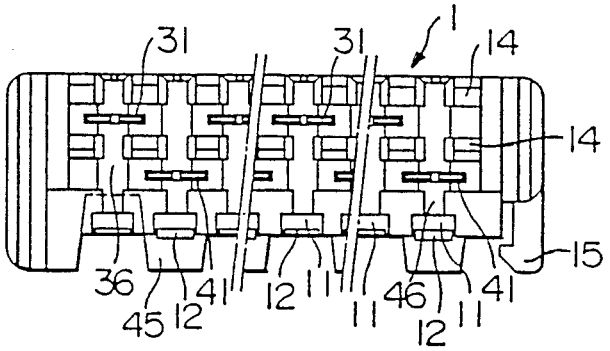
FIG. 2 is a plan view of one body for the connector shown in FIG. 1.

Then, these two bodies 1 are connected to each other as shown in FIG. 1, which completes the electrical connection for the wires 5.

At this time, if the space defined by the wall 45 of the male terminal 43 has been preloaded with grease or the like, two bodies 1, when urged, cause a pumping operation by which the grease is driven out onto the upper surface of the body 1 automatically from the hole 12 through the passage 13, thus enabling effective sealing thereby. On the other hand, the grease within each of the recesses 35, 45 about the respective terminals 33, 43 is distributed onto the upper portion from the openings 14 through the gaps around these terminals.

In the foregoing, the pressing of the covers 2 onto the bodies 1 was described as an operation independent of that for pushing down the blades 6. The connector of the present invention, however, also makes it possible to complete the two kinds of operations in a single handling.

EFFECT OF THE INVENTION

As noted above, in the connector of the present invention, the respective terminals are kept fully protected and at the same time they are both adapted to be so properly guided that correct connection can be established between them. Further, an enlarged electric insulation distance along surface can be obtained for the contact elements and, in addition, strength at the time of connection can also be improved. Furthermore, the recessed portions around the terminals function as reservoirs for grease, which therefore can be distributed over various portions of the connector at the time of connection.

I claim:

1. A connector for splicing telephone cables each having at least a pair of wires therein, said connector comprises a body having four sides and ends, a cover to be placed on a first side of said body and at least a pair of contact elements held in said body, each of said contact elements having a U-shaped wire receiving portion at one end thereof and positioned at said first side, a testing tab positioned for access from a second side opposite said first side, and a terminal at the other end thereof and positioned at a third side adjacent said first side, said terminals including at least one projected male terminal and at least one retracted female terminal provided adjacent to said male terminal, said male terminal being surrounded by an insulating wall, said female terminal being positioned in a recess formed adjacent to said male terminal, said insulating wall surrounding said male terminal being of a configuration to fit within said recess around the female terminal so that said insulating wall may be snugly inserted into a female terminal recess of a mating connector.

2. A connector for splicing telephone cables each having at least a pair of wires therein, said connector comprising a pair of bodies each having four sides and ends, a cover to be placed on each said body at a first side thereof and at least a pair of contact elements held in each said body, each of said contact elements having a U-shaped wire receiving portion at one end thereof and positioned at said first side, a testing tab positioned for access from a second side opposite said first side, and a terminal at the other end thereof and positioned at a third side which third side of each body mates with each other, said terminals in one body including at least one projected male terminal surrounded by an insulating wall, said terminals in the other body including at least one female terminal, said female terminal being positioned in a recess formed in said third side adapted to be juxtapositioned to the mating side on the other body opposite an insulating wall whereby said insulating wall surrounding said male terminal can fit within said recess around the female terminal so that said insulating wall on one body may be snugly inserted into a female terminal recess of the other body when said splice is completed, and said wires extending from a fourth side of each said body.

* * * * *